US005690755A

United States Patent [19]

Yoshinaga et al.

[11] Patent Number: 5,690,755

[45] Date of Patent: *Nov. 25, 1997

[54] COLD-ROLLED STEEL SHEET AND HOT-DIP GALVANIZED COLD-ROLLED STEEL SHEET HAVING EXCELLENT BAKE HARDENABILITY, NON-AGING PROPERTIES AT ROOM TEMPERATURE AND GOOD FORMABILITY AND PROCESS FOR PRODUCING THE SAME

[75] Inventors: Naoki Yoshinaga; Kohsaku Ushioda; Osamu Akisue; Yoshikazu Matsumura, all of Futtsu; Kunio Nishimura, Kitakyusyu, all of Japan

[73] Assignee: Nippon Steel Corporation, Tokyo, Japan

[ * ] Notice: The term of this patent shall not extend beyond the expiration date of Pat. No. 5,384,206.

[21] Appl. No.: 712,247

[22] Filed: Sep. 11, 1996

Related U.S. Application Data

[63] Continuation of Ser. No. 232,066, filed as PCT/JP93/01231, Aug. 31, 1993, abandoned.

[30] Foreign Application Priority Data

| | | | |
|---|---|---|---|
| Aug. 31, 1992 | [JP] | Japan | 4-232301 |
| Aug. 31, 1992 | [JP] | Japan | 4-232319 |
| Mar. 4, 1993 | [JP] | Japan | 5-044108 |

[51] Int. Cl.[6] ..... B32B 15/18; C21D 7/02

[52] U.S. Cl. ..... 148/533; 148/603; 148/320; 148/333; 420/87; 420/88; 428/659

[58] Field of Search ..... 148/533, 603, 148/320, 333; 420/87, 88; 428/659

[56] References Cited

U.S. PATENT DOCUMENTS

| | | | |
|---|---|---|---|
| 4,368,084 | 1/1983 | Irie et al. | 148/533 |
| 4,708,748 | 11/1987 | Satoh et al. | 148/603 |
| 5,384,206 | 1/1995 | Ushioda et al. | 428/659 |

FOREIGN PATENT DOCUMENTS

| | | |
|---|---|---|
| (A)-50-75113 | 6/1975 | Japan . |
| (A)-51-39524 | 4/1976 | Japan . |
| (B)-53-22052 | 7/1978 | Japan . |
| (B)-53-39368 | 10/1978 | Japan . |
| (A)-55-122820 | 9/1980 | Japan . |
| (A)-55-122821 | 9/1980 | Japan . |
| (A)-56-142852 | 11/1981 | Japan . |

(List continued on next page.)

OTHER PUBLICATIONS

Abstract of Janpan No. 4–214820 published Aug. 5, 1992.
Abstract of Japan No. 5–078783 published Mar. 30, 1993.
Abstract of Japan No. 5–078784 published Mar. 30, 1993.
Supplementary European Search Report No. 93 91 9599.

*Primary Examiner*—Sikyin Ip
*Attorney, Agent, or Firm*—Kenyon & Kenyon

[57] ABSTRACT

The present invention provides a cold-rolled steel sheet and a hot-dip galvanized steel sheet having good bake hardenability, non-aging properties at room temperature and good formability and a process for producing the same. An extra low carbon steel or an extra low carbon steel containing at least one element selected from Ti and Nb is annealed at a temperature of not lower than the $AC_3$ transformation point to bring the structure after annealing to a structure of low-temperature transformation products. This makes it possible to provide a steel sheet that has a combination of high paint-bake hardenability and non-aging properties at room temperature and is excellent also in formability in respect of average r value (deep drawability) and elongation (punch stretchability). In particular, with respect to paint-bake hardenability, a BH property on a high level up to about 10 kgf/mm$^2$ can be imparted according to need, and it is possible to provide a cold-rolled steel sheet and a hot-dip galvanized cold-rolled steel sheet that also have a non-aging property at room temperature.

19 Claims, 3 Drawing Sheets

FOREIGN PATENT DOCUMENTS

| | | | |
|---|---|---|---|
| (A)-57-41349 | 3/1982 | Japan . | |
| (A)-57-43932 | 3/1982 | Japan . | |
| (A)-57-67129 | 4/1982 | Japan . | |
| (B)-57-57945 | 12/1982 | Japan . | |
| (A)-58-48636 | 3/1983 | Japan . | |
| (A)-58-136721 | 8/1983 | Japan . | |
| (A)-58-141335 | 8/1983 | Japan . | |
| (B)-58-57492 | 12/1983 | Japan . | |
| (A)-59-31827 | 2/1984 | Japan . | |
| (A)-59-38337 | 3/1984 | Japan . | |
| 59-140333 | 8/1984 | Japan . | |
| 59-143027 | 8/1984 | Japan . | |
| (B)-59-42742 | 10/1984 | Japan . | |
| (A)-60-103128 | 6/1985 | Japan . | |
| (A)-60-174852 | 9/1985 | Japan . | |
| 61-281852 | 12/1986 | Japan . | |
| (B)-62-40405 | 8/1987 | Japan . | |
| (B)-62-56209 | 11/1987 | Japan . | |
| (A)-63-190141 | 8/1988 | Japan . | |
| (A)-64-62440 | 3/1989 | Japan . | |
| (A)-2-111841 | 4/1990 | Japan . | |
| (A)-2-232316 | 9/1990 | Japan . | |
| (B)-3-2224 | 1/1991 | Japan . | |
| 3-2224 | 1/1991 | Japan . | |
| (B)-3-21611 | 3/1991 | Japan . | |
| 3-21611 | 3/1991 | Japan . | |
| (A)-3-226544 | 10/1991 | Japan . | |
| (A)-3-277741 | 12/1991 | Japan . | |
| 3-277741 | 12/1991 | Japan . | |
| 3-281732 | 12/1991 | Japan | 148/533 |
| WO 92/16668 | 3/1992 | WIPO . | |

COLD-ROLLED STEEL SHEET AND HOT-DIP GALVANIZED COLD-ROLLED STEEL SHEET HAVING EXCELLENT BAKE HARDENABILITY, NON-AGING PROPERTIES AT ROOM TEMPERATURE AND GOOD FORMABILITY AND PROCESS FOR PRODUCING THE SAME

This application is a continuation of application Ser. No. 08/232,066 filed as PCT/JP93/01231 Aug. 31, 1993, now abandoned.

TECHNICAL FIELD

The present invention relates to a cold-rolled steel sheen and a hot-dip galvanized cold-rolled steel sheet having excellent bake hardenability, non-aging properties at room temperature and good formability and a process for producing the same.

The cold-rolled steel sheet according no the present invention is subjected to press molding before use in automobiles, domestic electric appliances, buildings, etc. In includes both a cold-rolled steel sheet in a narrow sense, which has an untreated surface, and a cold-rolled steel sheet subjected to surface treatments, such as galvanizing or alloyed galvanizing, for rust preventive purposes. Since the steel sheet according to the present invention has a combination of strength with formability, use thereof enables the sheet thickness to be reduced to a greater extent than with conventional steel sheets. In other words, a reduction in weight is possible. Therefore, the steel sheet of the present invention can be expected to contribute no the protection of the environment.

BACKGROUND ART

The production of an extra low carbon steel by a melt process has now become easy by virtue of advances in a vacuum degassing process for molten steels in recent years. This has led to an ever-increasing demand for extra low carbon steel sheets having a good formability. Among them, extra low carbon steel sheets disclosed in, for example, Japanese Unexamined Patent Publication (Kokai) Nos. 59-31827 and 59-38337, wherein Ti and Nb are added in combination, have a combination of very good formability and paint-bake hardenability (BH) and are also excellent in hot-dip galvanizing properties, so that they hold an important position in this field. The BH level of these sheets, however, does not exceed the level of the conventional BH steel sheets, and an attempt to further enhance the BH level unfavorably makes it impossible to ensure that non-aging properties at room temperature. Further, numerous extra low carbon steel sheets containing neither Ti or Nb and having an excellent formability have been disclosed, and examples thereof include those disclosed in Japanese Examined Patent Publication (Kokoku) No. 53-22052 and Japanese Unexamined Patent Publication (Kokai) Nos. 58-136721 and 58-141335.

Meanwhile, many attempts to enhance the strength of steel sheets while ensuring the formability thereof have hitherto been made in the art. In particular, in the case of steel sheets having a tensile strength in the range of from 30 to 50 kgf/mm$^2$, which are similar to those of the present invention, P, Si, etc. have been added to the steels to increase the strength through the utilization of solid solution strengthening by P and Si. For example, Japanese Unexamined Patent Publication (Kokai) Nos. 59-31827 and 59-38337 disclose a production process in which Si and P are mainly added to an extra low carbon steel sheet containing Ti and Nb to produce a high-strength cold-rolled steel sheet having a tensile strength up to 45 kgf/mm$^2$. Japanese Examined Patent Publication (Kokoku) No. 57-57945 discloses a representative prior art technique in which P is added to an extra low carbon steel containing Ti to produce a high-strength cold-rolled steel sheet. Further, with respect to extra low carbon steels containing neither Ti nor Nb, Japanese Examined Patent Publication (Kokoku) No. 58-57492 and Japanese Unexamined Patent Publication (Kokai) No. 58-48636 disclose a technique in which P is added to enhance the strength, and Japanese Unexamined Patent Publication (Kokai) No. 57-43932 discloses a technique in which Si is utilized.

Thus, P has hitherto been most extensively used as a reinforcing element with Si being the second most extensively used reinforcing element. This is because P and Si have been considered to have a very high solid solution strength capability, enable the strength to be increased by addition thereof in a minor amount, cause no significant lowering in ductility and deep drawability and further incur no significant increase in cost derived from the addition of these elements. In fact, however, an attempt to attain the increase in strength by addition of these elements alone causes not only strength but also yield strength to be remarkably increased, which renders the face shape unsatisfactory, so that use thereof in panels for automobiles is often limited. Further, when steel sheets of this type are subjected to hot-dip galvanizing, Si induces a failure in plating or P and Si remarkably lower the allowing rate, so that the productivity is lowered.

On the other hand, use of Mn and Cr as the solid solution strengthening element is also known in the art. Japanese Unexamined Patent Publication (Kokai) Nos. 63-190141 and 64-62440 disclose a technique in which Mn is added to an extra low carbon steel sheet containing Ti, and Japanese Examined Patent Publication (Kokoku) No. 59-42742 and the above-described Japanese Examined Patent Publication (Kokoku) No. 57-57945 disclose a technique in which Mn and Cr are added to an extra low carbon steel sheet containing Ti. Further, Japanese Unexamined Patent Publication (Kokai) No. 62-40352 discloses a technique in which Mn is added to an extra low carbon steel containing neither Ti nor Nb. However, (i) the addition of Mn and Cr plays only an auxiliary role for P and Si as main elements added, so that the resultant cold-rolled steel sheet has a high yield strength for the strength, and (ii) these elements are not added for purposes other than the above (i), for example, of course, these elements are not added for the purpose of (a) bringing the structure after annealing to a structure of low-temperature transformation products, which is a characteristic feature of the present invention, and, further, are not intentionally added for the purpose of (b) improving the work hardenability, (c) imparting a BH property, (d) improving the fabricability and (e) improving the platability in hot-dip galvanizing.

Further, Japanese Unexamined Patent Publication (Kokai) No. 2-111841 discloses a cold-rolled steel sheet and a hot-dip galvanized steel sheet having a bake hardenability and a good formability, comprising a Ti-containing extra low carbon steel and, added thereto, from 1.5 to less than 3.5% of Mn. In the steel sheets, an improvement in operating stability of hot rolling and in the homogeneity of the metallic structure through a lowering in $Ar_3$ transformation point is intended by the addition of a large amount of Mn. Further, the addition of Cr and V in amounts in the range of from 0.2 to 1.0% is also disclosed with a view to further improving the ductility. This proposal, however, is not based on the idea that the addition of large amounts of Mn and Cr contribute to an improvement in mechanical properties, particularly to a balance between strength and ductility. Further, in this case as well, the BH level falls within the conventional BH level range, and a combination of high BH and non-aging properties at room temperature could have not be attained in the above technique.

In addition to the above-described steel sheets having a single-phase structure of ferrite, steel sheets having a composite structure are also known in the art. A representative example thereof is a steel called a "dual phase steel" (DP steel) comprising a mixture of a ferritic phase with a martensitic phase, which steel is produced by adding alloying elements, such as Si, Mn Cr, to a low carbon aluminum killed steel, and optimizing the continuous annealing temperature and the rate of subsequent cooling. Such DP steel is known to have a very low yield ratio (YR) while enjoying high strength and, further, having a high BH level and non-aging at room temperature. However, it has a drawback in that the average r value is as low as about 1.0 and the deep drawability is poor. Incidentally, processes for producing such a cold-rolled steel sheet are disclosed in Japanese Examined Patent Publication (Kokoku) No. 53-39368, Japanese Unexamined Patent Publication (Kokai) Nos. 50-75113 and 51-39524 and Japanese Examined Patent Publication (Kokoku) Nos. 62-56209 and 62-40405.

Against the above-described steel sheet having a composite structure comprising a low carbon aluminum killed steel as a raw material, Japanese Examined Patent Publication (Kokoku) Nos. 3-2224 and 3-21611 and Japanese Unexamined Patent Publication (Kokai) No. 3-277741 disclose steel sheets having a composite structure comprising an extra low carbon steel as a raw material. In these steels, large amounts of Nb and B in combination with Ti are added to an extra low carbon steel to bring the structure after annealing to a composite structure comprising a ferritic phase and a phase formed by low-temperature transformation, thereby providing a cold-rolled steel sheet having a combination of a high r value, a high BH level, a high ductility with non-aging properties at room temperature.

However, as a result of extensive and intensive studies, the present inventors have found that the formation of a composition structure by adding Nb and B and optionally Ti has the following problems;

1) Since the ($\alpha+\gamma$) temperature region is very narrow, the structure varies in the thickness, width and longitudinal directions of the sheet, so that the quality varies greatly or a change in annealing temperature by several °C. renders the formation of the composite structure possible in some cases and impossible in other cases. Therefore, the production becomes very unstable.

2) It is difficult to impart a BH property on a level of not less than 5 kgf/mm$^2$. Further, even though the BH level could exceed 5 kgf/mm$^2$, the YP-E1 after artificial aging unfavorably exceeds 0.2%, so that the non-aging properties at room temperature cannot be ensured. Japanese Unexamined Patent Publication (Kokai) No. 3-277741 discloses a technique where a steel comprising an extra low carbon steel and, added thereto, Nb, B, Ti and further Mn or Cr is annealed at a temperature in the range of from ($Ac_1$–50° C.) to below the $Ac_1$ transformation point to bring the structure of the steel to a composite structure comprising an acicular ferrite having a percentage volume of not more than 5% and ferrite, thereby providing a steel sheet having a combination of a BH property with a non-aging properties at room temperature and a good formability.

However, as a result of detailed studies, the present inventors have found that the above technique has the following problems. Specifically, in a steel comprising a composite structure having a percentage volume of not more than 5% in the second phase, it is difficult to impart a BH property on a level comparable or superior to the conventional level, that is, on the level of not less than 5 kgf/mm$^2$. Further, even though the BH level could exceed 5 kgf/mm$^2$, the YP-El after artificial aging unfavorably exceeds 0.2%, so that it is very difficult to ensure the non-aging properties at room temperature. This problem is considered attributable to a low percentage volume of the second phase which results in a unsatisfactory movable dislocation density introduced into ferrite.

Thus, several proposals have been made regarding steel sheets having a composite structure produced from an extra low carbon steel. In such steel sheets, it is most unlikely for the BH level to exceed the conventional BH level range, and with respect to the non-aging properties, the value remains on a level slightly exceeding the conventional level.

Good retention of face shape, enough to prevent occurrence of spring back, face strain and other unfavorable phenomena, after pressing is required of steel sheets used in panels for automobiles and the like. It is known that the retention of face shape improves with lowering the yield strength. As described above in connection with the prior art, an increase in strength of the steel sheet generally gives rise to a remarkable increase in yield strength. For this reason, when the strength is increased, it is necessary to minimize the increase in yield strength.

Further, the steel sheet after press molding is required to have denting resistance. The term "denting resistance" is intended to mean resistance of the steel sheet to permanent depression deformation when stones or the like hit against assembled automobiles or the like. Assuming the sheet thickness is constant, the denting resistance becomes better with increasing the deformation stress after press molding and painting/baking. Therefore, when steels sheets have the same yield strength, the denting resistance improves with increasing the paint-bake hardenability and increasing the work hardenability.

From the above facts, steel sheets desirable for use in panels for automobiles are those having a combination of such properties that the yield strength is not very high, work hardening is significant and paint-bake hardenability is high. It is a matter of course that they should be excellent also in formability in respect of the average r value (deep drawability) and elongation (punch stretchability). Further, they should have substantially non-aging at room temperature.

An object of the present invention is to provide a cold-rolled steel sheet and a hot-dip galvanized cold-rolled steel sheet unattainable by the prior art, which can satisfy the above-described demands, particularly with respect to the paint-bake hardenability, can impart a BH property on a high level of not less than 5 kgf/mm$^2$ depending upon purposes and also have a non-aging properties at room temperature, and a process for producing the same.

DISCLOSURE OF THE INVENTION

The present inventors have made extensive and intensive studies with a view to attaining the above-described object and, as a result, have obtained the following novel finding.

Specifically, Mn, B and Cr were added to a base material comprising an extra low carbon steel containing neither Nb nor Ti or a base material comprising an extra low carbon steel and, added thereto, one or a combination of Nb and Ti (for example, a steel having a composition of 0.003% C.-0.01% Si-0.15% Mn-0.008% P-0.003% S-0.05% Al-0.012% Ti-0.02% Nb-0.0015% B), and studies have been made on the structure and tensile properties after cold rolling, annealing and temper rolling, particularly a difference in the structure and tensile properties between annealing in a two-phase region of $\alpha+\gamma$ and annealing in a $\gamma$ single-phase region.

As a result, when annealing was effected in the two-phase region of $\alpha+\gamma$, a composite structure comprising ferrite and low-temperature transformation products could be formed. However, it has been found that 1) the temperature range capable of forming the composite structure is so narrow that a variation in quality during the production is very large and 2) in such a steel, not only it is difficult to impart a BH level of not less than 5 kgf/mm$^2$, but also the elongation at yield point (YP-El) after artificial aging unfavorably exceeds 0.2% even though the BH level is not less than 5 kgf/mm$^2$, so that the non-aging properties at room temperature cannot be ensured.

On the other hand, it was found that annealing in a $\gamma$ single-phase region has the following features as compared with annealing in an $(\alpha+\gamma)$ two-phase region.

1) Since the annealing is effected in a $\gamma$ single-phase region, the structure after annealing can be brought to a structure of low-temperature transformation products, so that the variation in quality during production is very small. The term "low-temperature transformation products" used herein is intended to mean all structures except for the so-called "polygonal ferrite" which are provided in annealing a ferritic single-phase temperature region. Specifically, the structure comprises at least one member selected from the group consisting of massive ferrite, bainite, Widmanstatten ferrite, martensite and acicular ferrite. 2) When Ti and Nb are added, carbides formed during hot rolling or coiling, such as TiC and NbC, are easily remelted in a $\gamma$ single-phase region, which enables a BH property on a level of not less than 5 kgf/mm$^2$ to be imparted efficiently. 3) even though the BH level is about 10 kgf/mm$^2$, there is no possibility that the YP-E1 after artificial aging exceeds 0.2%, so that a combination of excellent non-aging properties at room temperature and an excellent BH property can be attained. Although the reason for this has not been completely elucidated, a high movable dislocation density introduced into the formed low-temperature transformation products is thought to lead to the above phenomenon.

The reason why the movable dislocation density attained by annealing in a $\gamma$ single-phase region is higher than that attained by annealing in an $(\alpha+\gamma)$ two-phase region is believed to reside in that the percentage volume of the low-temperature transformation products becomes high.

The influence of ingredient elements on non-aging properties in the stage of annealing at a temperature capable of providing a $\gamma$ single-phase region was then examined.

For example, the influence of Mn was examined by adding Mn to a 0.003% C-0.01% Ti-0.02% Nb steel, and the influence of Ti, Nb; B and Cr was examined by adding these elements to a 0.003% C-0.01% Mn steel. The results are shown in FIGS. 1 and 2. As is apparent from FIG. 1, addition of Mn in an amount of not less than 0.3% contributes to a particular improvement in non-aging properties at the temperature. The effect of improving the non-aging properties was similarly attained when neither Ti nor Nb was added. However, no excellent non-aging properties could be provided when the amount of Mn added was less than 0.3%.

Further, from FIG. 2, it is apparent that addition of Ti, Nb, B and Cr in respective amounts capable of satisfying a requirement represented by the following formula is preferred from the viewpoint of improving the non-aging properties:

$$10(Ti+Nb)+100B+Cr \geqq 0.1 (\%\ by\ weight).$$

Based on the above experimental results, the present inventors have conducted further studies on the relationship between these elements and the amount of Mn added and, as a result, have found that, when the Mn content is less than 0.3%, in order to improve the non-aging properties, addition of Ti or Nb is necessary and it is preferred to satisfy the requirement represented by the above formula.

Further, annealing in a $\gamma$ region enabled a BH property on a level of not less than 5 kgf/mm$^2$ to be stably imparted.

Further, samples were prepared in the same manner as that of Example 1 using sample No. 4-1 (steel of the present invention) and sample No. 4-4 (comparative steel) specified in Table 1 and used to examine the relationship between the deed drawability (r value) and the annealing temperature of the samples. The results are given in FIG. 3.

As is apparent from FIG. 3, in the sample to which Mn was added in the large mount of 2.20%, when annealing was effected in a $\gamma$ single-phase region of about 850° C. or above as the $Ac_3$ transformation point, a high r value of about 1–8 could be attained and the r value remains high even when the annealing temperature was as high as about 1000° C.

On the other hand, in the composite sample of which the P content was outside the scope of the present invention, even when the Mn content was 0.57%, annealing in a $\gamma$ single-phase region (a region of 960° C. or above) caused the r value to be rapidly lowered to about 1.2.

Thus, excellent non-aging properties at room temperature and a good BH property and a high r value derived from a structure of low-temperature transformation products can be simultaneously attained by annealing a steel having a composition falling within the scope of the present invention in a $\gamma$ single-phase region.

Further, the present inventors have found that the steel of the present invention is advantageous also as a hot-dip galvanized cold-rolled steel sheet. Specifically, addition of large amounts of Si or p to steels is known to deteriorate the platability of the steels in the hot-dip galvanizing and, further, causes delay of the subsequent alloying reaction. By contrast, steels containing Mn or Cr cause no deterioration in platability in the hot-dip galvanizing even when they contain large amounts of Si and P. The present inventors have also carried out studies on the influence of B and, as a result, have found that a large amount of B has an adverse effect on platability in the hot-dip galvanizing and the alloying reaction.

Further, a lowering in the P and Si contents is advantageous also from the viewpoint of lowering the $Ac_3$ point.

The present invention provides a novel steel sheet based on the above-described idea and novel finding, and the subject matter of the present invention resides in a cold-rolled steel sheet or a hot-dip galvanized cold-rolled steel sheet, comprising, in terms of % by weight, 0.0005 to 0.0070% of C, 0.001 to 0.8% of Si, 0.3 to 4.0% of Mn, 0.002 to 0.15% of P, 0.0005 to 0.015% of S, 0.005 to 0.1% of Al and 0.0003 to 0.0060% of N and optionally further comprising at least one element selected from B in an amount capable of satisfying a requirement of less than 0.0030% and $B/N \leqq 1.5$ and 0.01 to 3.0% of Cr with the balance consisting of Fe and unavoidable impurities and having a structure of low-temperature transformation products, and a cold-rolled steel sheet or a hot-dip galvanized cold-rolled steel sheet, comprising, in terms of % by weight, 0.0005 to 0.0070% of C, 0.001 to 0.8% of Si, 0.01 to 4.0% of Mn, 0.002 to 0.15% of P, 0.0005 to 0.015% of S, 0.005 to 0.2% of Al, 0.0003 to 0.0060% of N and at least one additional element selected from 0.003 to 0.1% of Ti and 0.003 and 0.1% of Nb and optionally further comprising at least one element selected from B in an amount capable of satisfying a requirement of less than 0.0030% and B/N≦1.5 and 0.01 to 3.0% of Cr with the balance consisting of Fe and unavoidable impurities and having a structure of low-temperature transformation products. The subject matter of the present invention resides also in a process for producing the above-described cold-rolled steel sheet and the like.

BEST MODE FOR CARRYING OUT THE INVENTION

Figure 1:
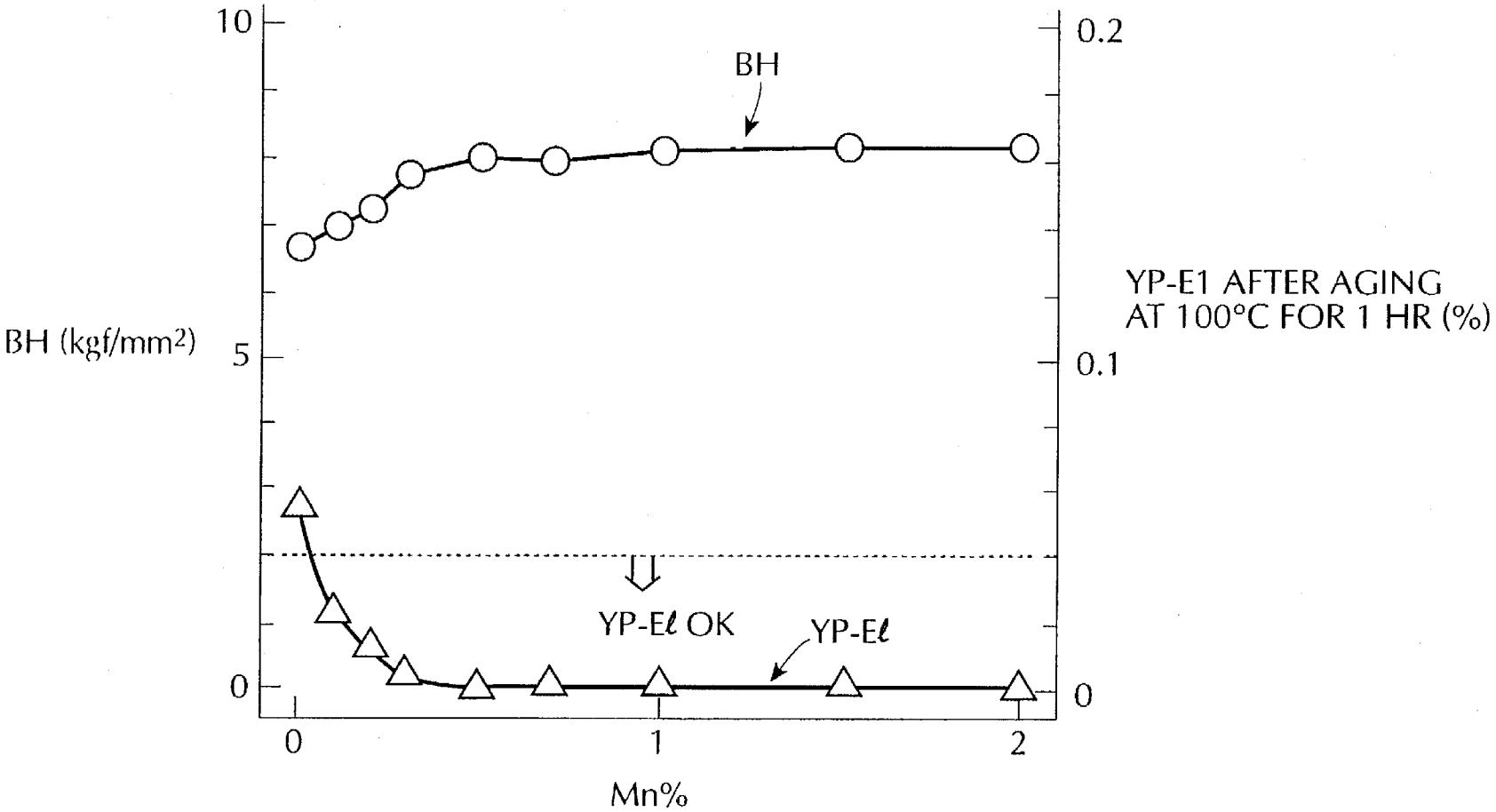
FIG. 1 is a diagram showing the relationship between Mn content and non-aging property and BH property.
Figure 2:
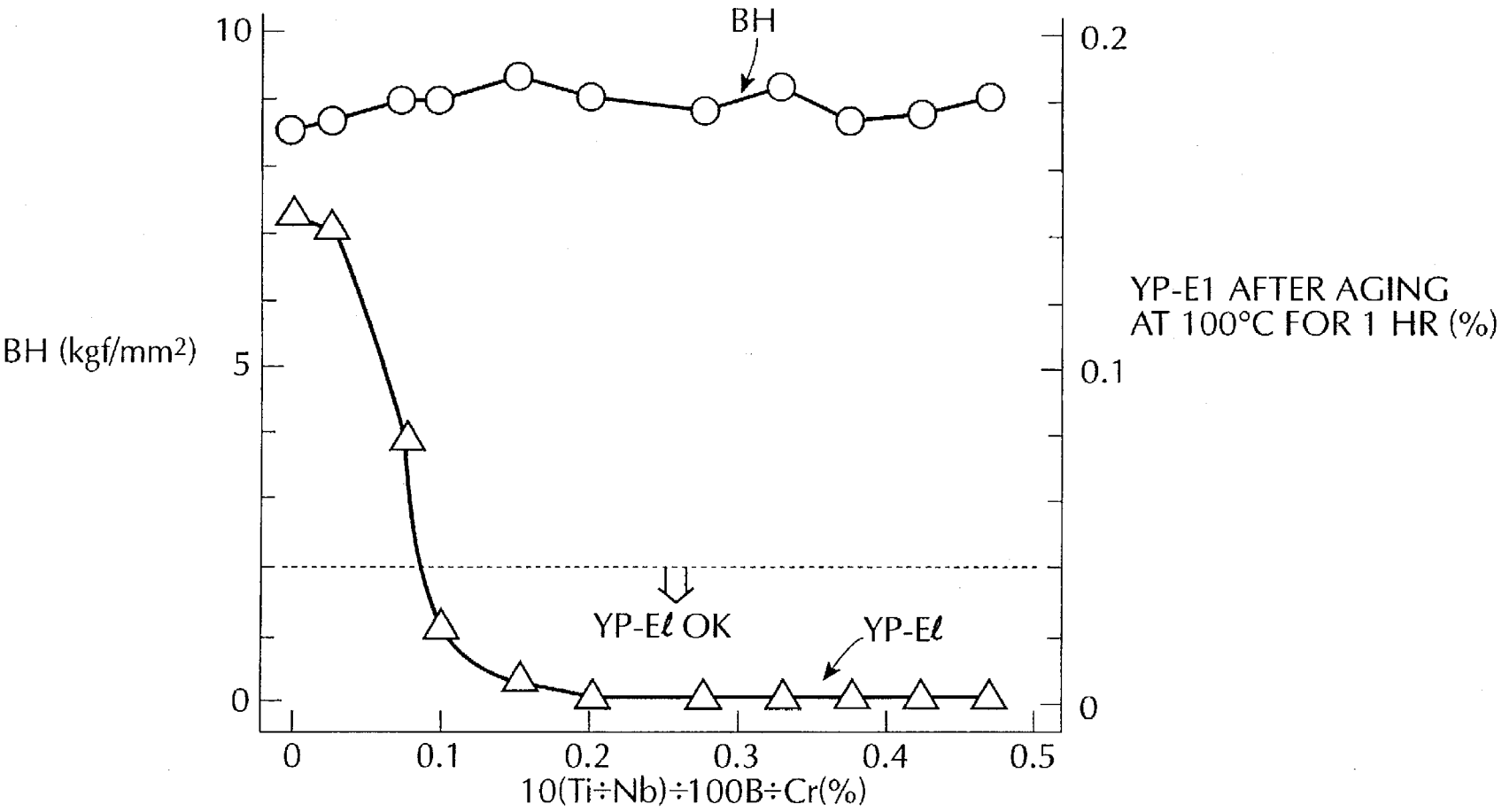
FIG. 2 is a diagram showing the relationship between values based on 10 (Ti+Nb)+100B+Cr (%) and non-aging property and BH property.
Figure 3:
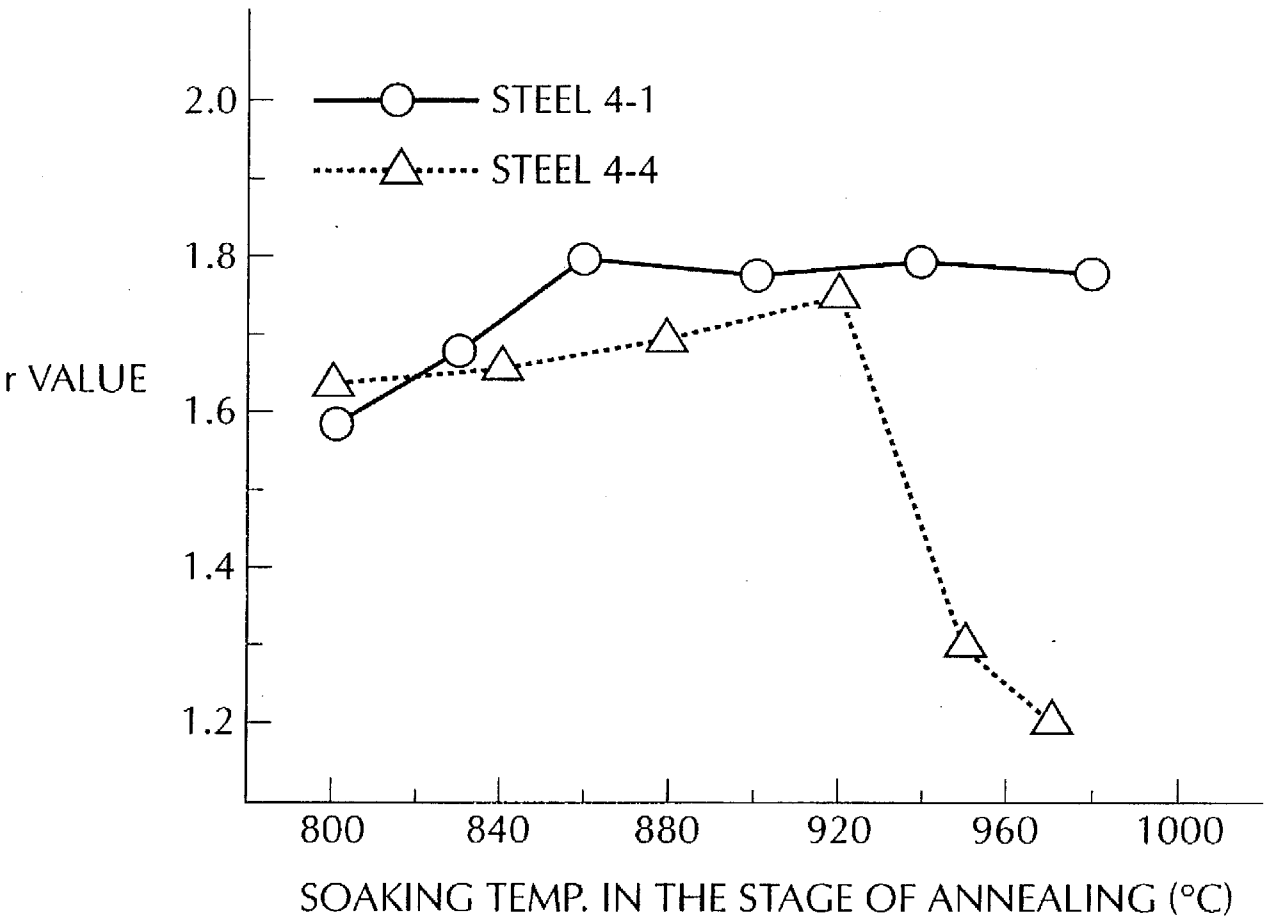
FIG. 3 is a diagram showing the relationship between temperature and r value with respect to the steel of the present invention and comparative steel.

The present invention will now be described in detail.

At the outset, the reason for the above-described limitation of the steel composition and structure in the present invention will be described.

C: C is a very important element for determining the quality of products. The present invention is on the premise that the steel is an extra low carbon steel which has been subjected to vacuum degassing. When the C content is less than 0.0005%, there occur a lowering in grain boundary strength, a deterioration in fabricability and a remarkable increase in production cost. For this reason, the lower limit of the C content is 0.0005%. On the other hand, when the C content exceeds 0.0070%, the moldability is deteriorated and non-aging properties at room temperature is not ensured. For this reason, the upper limit of the C content is 0.0070%.

Si: Si is known to be an element that can economically increase the strength. The amount of Si to be added varies depending upon the target strength level. However, when it exceeds 0.8%, an increase in yield strength becomes so large that face strain occurs during press molding. Further, in this case, the $AC_3$ transformation point increases, so that the annealing temperature for providing the structure of low-temperature transformation products becomes remarkably high. Further, there occur problems such as a lowering in conversion treatability, a lowering in adhesion of hot-dip galvanized coating and a lowering in productivity due to delay of the alloying reaction. The lower limit of Si is 0.001% from the viewpoint of steelmaking techniques and cost.

Mn: Mn is the most important element for the present invention. Specifically, since Mu lowers the $Ac_3$ transformation point, the temperature necessary for the formation of a structure of low-temperature transformation products is not very high. Further, in a steel sheet having a structure of low-temperature transformation products provided by utilizing Mn, it is possible to easily impart a BH level of not less than 5 kgf/mm$^2$ unattainable by the conventional techniques. Further, a excellent non-aging properties at room temperature can be attained also when the BH level is 5 kgf/mm$^2$ or more.

This property is characteristic of steel sheets having a structure of low-temperature transformation products and cannot be provided in steel sheets having a ferritic single-phase structure and steel sheets having a composite structure provided by adding a large amount of B. What is more important is as follows. The conventional steels are commonly known to cause a remarkable deterioration in the r value when annealed in a $\gamma$ single-phase region. For this reason, the annealing temperature has been limited to the $Ae_3$ or $Ac_3$ point or lower temperature. In contrast, in steels to which Mn and Cr have been positively added, the r value is hardly deteriorated even when annealing is effected in a $\gamma$ single-phase region.

Further, Mn is a solid solution strengthening element useful for increasing the strength without causing a significant increase in yield strength and also has the effect of improving the conversion treatability or improving the platability in hot-dip galvanizing. With respect to the content of Mn, the lower limit is 0.01% from the viewpoint of steelmaking techniques. However, in order to attain the above-described effect, it is preferred to add Mn in an amount of not less than 0.3%. Further, when Mn is added in an amount of 0.6% or more, it becomes possible to most significantly attain the effect of lowering the annealing temperature necessary for the formation of a structure of low-temperature transformation products, the effect of improving the non-aging properties and other effects. On the other hand, when the amount of Mn added exceeds 4.0%, the cost becomes high and the formability is deteriorated.

P: As with Si, P is known to be an element which can economically increase the strength, and the amount of P to be added varies depending upon the target strength level. When the amount added exceeds 0.15%, the annealing temperature necessary for the formation of a structure of low-temperature transformation products becomes remarkably high and the yield strength becomes so high that a failure of face shape occurs during pressing. Further, in the stage of continuous hot-dip galvanizing, the alloying reaction rate is so low that the productivity lowers. Further, the fabricability too is deteriorated. For this reason, the upper limit is 0.15%. The lower limit is 0.002% from the viewpoint of steelmaking techniques and cost. However, in order to attain the above-described effect, it is preferred for the P content to be not less than 0.005%.

S: The lower the S content, the better the results. However, when the S content is less than 0.0005%, the production cost becomes so high that the lower limit is 0.0005%. On the other hand, when it exceeds 0.015%, a large amount of MnS is precipitated to deteriorate the formability, so that the upper limit is 0.015%.

Al: Al is used for deoxidation and fixation of nitrogen. When the Al content is less than 0.005%, the effect is unsatisfactory. On the other hand, when it exceeds 0.2%, the cost is increased, so that the upper limit is 0.2%. N: The lower the N content, the better the results. However, when the N content is lower than 0.0003%, the cost is remarkably increased. On the other hand, when it is excessively high, a large amount of Al becomes necessary or the formability is deteriorated. For this reason, the upper limit is 0.0060%.

Ti, Nb, B and Cr: Ti and Nb serve to fix the whole or part of N, C and S, thereby enabling the formability and non-aging properties of the extra low carbon steel to be ensured. Further, they refine grains of the hot-rolled sheet to render the formability of the product sheet good. Further, B is useful for preventing fabrication embrittlement, and Cr has an excellent effect of enhancing the BH property and work hardenability. The above elements are added when an enhancement in the above properties is desired.

As with Mn, Ti, Nb, B and Cr are useful for attaining excellent BH properties and non-aging properties when annealing is effected in a γ region. They are also useful for maintaining a high r value. In particular, when the Mn content is less than 0.3% by weight, an addition of Ti or Nb is necessary. In this case, it is preferred for Ti and Nb to be added in respective amounts capable of satisfying the requirement: $10(Ti+Nb)+100B+Cr \geqq 0.1$.

From the viewpoint of alloy cost and ensuring the formability, the upper limit of the content of the above elements is 0.1% by weight for Ti and Nb, 0.0030% by weight for B and 3.0% by weight for Cr. On the other hand, the lower limit of the content of the above elements is a minimum value necessary for attaining the intended effect.

with respect to the strength, all the steel sheets having a strength of not less than 25 kgf/mm$^2$ fall within the scope of the present invention. However, in order to provide a good r value as the structure of low-temperature transformation products, it is preferred for the strength to be 35 kgf/mm$^2$.

The reason for limitation of production conditions will now be described.

A slab having the above-described composition is heated in the temperature range of from 900° to 1,400° C. and then hot-rolled.

The finishing temperature of the hot rolling should be not less than $(Ar_3-100)$°C. from the viewpoint of ensuring the formability of the product sheet. The coiling temperature for the hot-rolled steel strip is in the range of from room temperature to 750° C. The present invention is characterized in that the quality of the product is not significantly influenced by the coiling temperature in the hot rolling.

The upper limit of the coiling temperature is determined from the viewpoint of preventing a lowering in yield attributable to a deterioration in the quality at both ends of the coil.

The hot-rolled steel strip is then cold-rolled. In this case, the rolling is effected with a reduction ratio of not less than 60% from the viewpoint of ensuring the deep drawability after annealing.

The cold-rolled steel strip thus obtained is transferred to a continuous annealing furnace while uncoiling the steel strip and annealed at the $Ac_3$ transformation point or above. When the annealing temperature is below the $AC_3$ transformation point, it is impossible to provide the structure of low-temperature transformation products characteristic of the present invention. Although there is no particular limitation on conditions for cooling after soaking in the stage of annealing, when a high elongation is required, cooling is preferably effected at an average rate of 30° C./sec or less until the temperature is lowered from the annealing temperature to 600° to 700° C. When a remarkably high BH property is required, cooling is preferably effected at an average rate of 30° C./sec or more until the temperature is lowered from the annealing temperature to 600° to 700° C. However, none of these conditions is essential.

When hot-dip galvanizing is effected after the annealing, the steel strip is cooled from the above-described annealing temperature and immersed in a galvanizing bath (temperature: 420° to 520° C., Al concentration of the bath: 0.05 to 0.3%) to galvanize the surface of the steel strip. Thereafter, the galvanized steel strip my be subjected to an alloying treatment commonly effected in the conventional galvanizing.

Thus, a cold-rolled steel strip and a hot-dip galvanized steel strip are produced. Thereafter, if necessary, the steel strip is subjected to temper rolling with a reduction ratio of 0.2 to 3% for the purpose of correcting the shape. In the present invention, the temper rolling for improving the aging property is not necessary.

As described above, according to the present invention, it is possible to provide a steel sheet which has a combination of a high paint-bake hardenability and non-aging properties at room temperature and is also excellent in formability in respect of average r value (deep drawability) and elongation (punch stretchability). In particular, with respect to paint-bake hardenability, a BH property on a high level of not less than 5 kgf/mm$^2$ can be stably imparted according to need, and it is possible to provide a cold-rolled steel sheet which also has non-aging properties at room temperature.

The present invention will now be described in more detail with reference to the following Examples.

EXAMPLES

Example 1

Steels having compositions specified in Table 1 were prepared by a melt process and hot-rolled under conditions of a slab heating temperature of 1,200° C., a finishing temperature of 920° C. and a coiling temperature of 700° C. to form steel strips having a thickness of 4.0 mm. After pickling, the steel strips were cold-rolled with a reduction ratio of 80% to form cold-rolled sheets having a thickness of 0.8 m and then subjected to continuous annealing under conditions of a heating rate of 10° C./sec, a soaking of 860° to 980° C. for 50 sec, an average rate of cooling to 650° C. of 3° C./sec and an average rate of cooling from 650° C. to room temperature of 80° C./sec. Further, the annealed sheet was subjected to temper rolling with a reduction ratio of 1.0%, and a JIS No. 5 tensile specimen was extracted therefrom and subjected to a tensile test. The results of the tensile test are summarized in Table 2.

In the table, the WH value is the level of work hardening when a 2% tensile strain is applied in the rolling direction. This value is determined by subtracting the yield stress (YP) from a 2% deformation stress. The BH property is the level of an increment of the stress when the tensile test is again effected after a 2% prestrained material is subjected to a heat treatment corresponding to painting baking at 170° C. for 20 min (that is, a value determined by subtracting 2% deformation stress from lower yield stress in the retensile test). The fabrication embrittlement transition temperature is a ductility-embrittlement transition temperature determined by punching a blank having a diameter of 50 mm from a temper-rolled steel sheet, molding a cup using a punch having a diameter of 33 mm and subjecting the cup to a drop weight test at various temperatures.

As is apparent from the annealing temperature given in Table 1, in the steels of the present invention, the annealing temperature necessary for the formation of a structure of low-temperature transformation products is considerably lower than that in the case of the comparative steels. Therefore, the steels can be produced without applying an excessive burden on continuous annealing equipment.

TABLE 1

Chemical Ingredients of Material Under Test (wt. %)

| Sample No. | C | Si | Mn | P | S | Al | Cr | N | B | B/N | Soaking temp., °C. | Percentage volume of low temp. transformation product, % | Remarks |
|---|---|---|---|---|---|---|---|---|---|---|---|---|---|
| 1-1 | 0.0025 | 0.012 | 0.34 | 0.008 | 0.007 | 0.05 | — | 0.0017 | 0.0005 | 0.29 | 910 | 100 | Invention |
| 1-2 | 0.0033 | 0.009 | 0.65 | 0.007 | 0.005 | 0.05 | 0.5 | 0.0021 | — | — | 910 | 100 | Invention |
| 1-3 | 0.0025 | 0.011 | 0.13 | 0.014 | 0.006 | 0.04 | — | 0.0016 | 0.0032 | 2.00 | 940 | 100 | Comparative steel |
| 2-1 | 0.0014 | 0.013 | 1.25 | 0.032 | 0.005 | 0.04 | — | 0.0022 | 0.0010 | 0.45 | 900 | 100 | Invention |
| 2-2 | 0.0042 | 0.010 | 1.20 | 0.008 | 0.005 | 0.04 | 0.7 | 0.0016 | — | — | 900 | 100 | Invention |
| 2-3 | 0.0039 | 0.021 | 0.55 | 0.015 | 0.008 | 0.05 | — | 0.0022 | 0.0040 | 1.82 | 930 | 100 | Comparative steel |
| 2-4 | 0.0027 | 0.011 | 0.20 | 0.011 | 0.007 | 0.04 | 0.5 | 0.0025 | 0.0059 | 2.36 | 940 | 100 | Comparative steel |
| 2-5 | 0.0020 | 0.550 | 0.10 | 0.016 | 0.005 | 0.04 | — | 0.0016 | 0.0002 | 0.13 | 960 | 100 | Comparative steel |
| 3-1 | 0.0019 | 0.008 | 1.54 | 0.065 | 0.006 | 0.04 | 1.0 | 0.0021 | 0.0008 | 0.38 | 890 | 100 | Invention |
| 3-2 | 0.0038 | 0.009 | 1.65 | 0.070 | 0.005 | 0.04 | — | 0.0017 | 0.0004 | 0.24 | 905 | 100 | Invention |
| 3-3 | 0.0039 | 0.009 | 0.15 | 0.090 | 0.006 | 0.04 | 0.8 | 0.0019 | 0.0035 | 1.84 | 950 | 100 | Comparative steel |
| 3-4 | 0.0041 | 0.022 | 1.20 | 0.025 | 0.006 | 0.04 | — | 0.0016 | 0.0045 | 2.81 | 930 | 100 | Comparative steel |
| 3-5 | 0.0030 | 0.150 | 0.55 | 0.090 | 0.005 | 0.04 | 0.3 | 0.0022 | — | — | 960 | 100 | Comparative steel |
| 4-1 | 0.0055 | 0.009 | 1.50 | 0.080 | 0.006 | 0.05 | — | 0.0020 | 0.0003 | 0.15 | 890 | 100 | Invention |
| 4-2 | 0.0031 | 0.011 | 2.10 | 0.075 | 0.008 | 0.04 | 1.3 | 0.0018 | — | — | 870 | 100 | Invention |
| 4-3 | 0.0075 | 0.850 | 0.35 | 0.060 | 0.005 | 0.05 | 0.2 | 0.0022 | 0.0036 | 1.64 | 970 | 100 | Comparative steel |
| 4-4 | 0.0028 | 0.300 | 0.57 | 0.120 | 0.006 | 0.04 | 0.5 | 0.0016 | 0.0004 | 0.25 | 980 | 100 | Comparative steel |
| 5-1 | 0.0031 | 0.250 | 1.85 | 0.110 | 0.007 | 0.04 | 1.0 | 0.0022 | 0.0006 | 0.27 | 890 | 100 | Invention |
| 5-2 | 0.0034 | 0.013 | 2.30 | 0.080 | 0.007 | 0.04 | 2.5 | 0.0019 | 0.0003 | 0.16 | 860 | 100 | Invention |
| 5-3 | 0.0037 | 0.370 | 0.40 | 0.160 | 0.009 | 0.04 | 0.8 | 0.0025 | 0.0003 | 0.12 | 900 | 100 | Comparative steel |

Further, as is apparent from Table 2, the steels of the present invention have a higher BH property than the conventional steel sheets having a tensile strength on the same level as the steel sheets of the present invention, and additionally have a very excellent non-aging properties at room temperature. This advantage is considered largely attributable to a better dislocation density of the steel sheet of which the structure of low-temperature transformation products has been formed using Mn or Cr as compared with other steel sheets. Another feature of the present invention is that substantially no deterioration in r value occurs despite annealing in a γ single-phase temperature region. Further, the steels of the present invention have a low yield strength, an excellent retention of face shape and a high WH value. Therefore, the steels of the present invention are suitable as a material, for example, for an outer or inner plate panel of automobiles.

Example 2

The influence of soaking temperature on continuous annealing was studied using steel No. 2-2 specified in Table 1. Conditions for hot rolling and cold rolling were the same as those of Example 1. Thereafter, the cold-rolled steel sheet was subjected to continuous annealing as follows. It was heated at a rate of 10° C./sec, held at a temperature in the range of from 840° to 940° C. for 50 sec, cooled to 650° C. at an average rate of 60° C./sec and then cooled from 650° C. to room temperature at an average rate of 80° C./sec. Further, the annealed sheet was subjected to temper rolling with a reduction ratio of 1.0%, and a JIS No. 5 tensile specimen was extracted therefrom and subjected to a tensile test. The results of the tensile test are summarized in Table 3.

As is apparent from Table 3, when a structure of low-temperature transformation products is formed by annealing in a γ single-phase region according to the present invention, an excellent quality can be stably provided even though the soaking temperature is changed. On the other hand, when annealing was effected in an (α+γ) two-phase region, a slight change in soaking temperature gave rise to a wide variation in BH property. Further, the YP-El after artificial aging was far higher than 0.2%, and the non-aging property could not be substantially ensured.

Example 3

Steel Nos. 3-1 to 3-5 and 4-1 to 4-4 specified in Table 1 were hot-rolled under conditions of a slab heating temperature of 1,200° C., a finishing temperature of 930° C. and a coiling temperature of 720° C. to form steel sheets having a thickness of 3.8 mm. After pickling, the steel sheets were cold-rolled to form cold-rolled sheets having a thickness of 0.75 mm, heated at a heating rate of 15° C./sec to a temperature specified in Example 1, cooled at a rate of about 70° C./sec, subjected to conventional hot-dip galvanizing at 460° C. (Al concentration of bath: 0.11%), further heated at 520° C. for 20 sec to effect alloying and then cooled to room temperature at about 20° C./sec. The resultant alloyed galvanized steel sheets were subjected to measurement of appearance of plating, powdering resistance and concentration of Fe in plating. The results are summarized in Table 4.

TABLE 2

| Sample No. | YP, kgf/mm² | TS, kgf/mm² | El, % | r value | WH, kgf/mm² | BH, kgf/mm² | YP-El*, % | σd**, kgf/mm² | Brittle transi-temp., °C. | Percentage volume of low temp. transfor-mation product, % | Remarks |
|---|---|---|---|---|---|---|---|---|---|---|---|
| 1-1 | 14 | 30 | 51 | 1.8 | 4.7 | 5.0 | 0.0 | 23.7 | −80 | 100 | Invention |
| 1-2 | 16 | 30 | 50 | 1.7 | 5.0 | 7.0 | 0.0 | 28.0 | −80 | 100 | Invention |
| 1-3 | 22 | 31 | 44 | 1.1 | 4.0 | 3.5 | 0.5 | 29.5 | −70 | 100 | Comparative steel |
| 2-1 | 17 | 35 | 47 | 1.9 | 5.5 | 3.2 | 0.0 | 25.7 | −75 | 100 | Invention |
| 2-2 | 18 | 36 | 45 | 1.6 | 5.6 | 10.4 | 0.1 | 34.0 | −80 | 100 | Invention |
| 2-3 | 27 | 36 | 39 | 1.1 | 4.0 | 5.0 | 0.7 | 36.0 | −70 | 100 | Comparative steel |
| 2-4 | 27 | 35 | 38 | 1.2 | 4.1 | 3.8 | 0.4 | 34.9 | −70 | 100 | Comparative steel |
| 2-5 | 25 | 35 | 37 | 1.2 | 3.3 | 2.9 | 0.3 | 31.2 | −20 | 100 | Comparative steel |
| 3-1 | 24 | 41 | 41 | 1.7 | 6.3 | 4.0 | 0.0 | 34.3 | −70 | 100 | Invention |
| 3-2 | 23 | 42 | 41 | 1.6 | 5.7 | 8.8 | 0.0 | 37.5 | −80 | 100 | Invention |
| 3-3 | 28 | 40 | 33 | 1.2 | 4.5 | 4.8 | 1.2 | 37.3 | −30 | 100 | Comparative steel |
| 3-4 | 29 | 42 | 31 | 1.1 | 4.2 | 5.2 | 1.4 | 38.4 | −50 | 100 | Comparative steel |
| 3-5 | 28 | 41 | 35 | 1.2 | 3.6 | 3.3 | 0.4 | 34 9 | −10 | 100 | Comparative steel |
| 4-1 | 25 | 46 | 40 | 1.5 | 6.0 | 11.4 | 0.1 | 42.4 | −70 | 100 | Invention |
| 4-2 | 24 | 45 | 39 | 1.6 | 6.2 | 7.2 | 0.0 | 37.4 | −70 | 100 | Invention |
| 4-3 | 33 | 47 | 29 | 1.1 | 4.8 | 4.5 | 0.8 | 42.3 | −70 | 100 | Comparative steel |
| 4-4 | 32 | 45 | 30 | 1.2 | 3.9 | 4.1 | 0.4 | 40.0 | −5 | 100 | Comparative steel |
| 5-1 | 28 | 51 | 37 | 1.5 | 7.3 | 6.0 | 0.0 | 41.3 | −70 | 100 | Invention |
| 5-2 | 27 | 50 | 38 | 1.5 | 6.3 | 6.8 | 0.0 | 40.1 | −65 | 100 | Invention |
| 5-3 | 37 | 50 | 27 | 1.1 | 4.6 | 5.9 | 0.6 | 47.5 | 0 | 100 | Comparative steel |

Note)
(1) *YP-El after artificial aging treatment at 100° C. for 1 hr
(2) **σd = YP + BH + WH

TABLE 3

| Sample No. | Soak-ing temp., °C. | YP, kgf/mm² | TS, kgf/mm² | El, % | r value | WH, kgf/mm² | BH, kgf/mm² | YP-El*, % | σd**, kgf/mm² | Brittle transi-temp., °C. | Percentage volume of low temp. transfor-mation product, % | Remarks |
|---|---|---|---|---|---|---|---|---|---|---|---|---|
| 2-2 | 840 | 17 | 37 | 44 | 1.7 | 5.5 | 5.4 | 0.7 | 27.9 | −50 | 3 | Comp. Ex. |
| | 860 | 18 | 36 | 45 | 1.5 | 5.7 | 7.1 | 0.5 | 30.8 | −70 | 38 | Comp. Ex |
| | 880 | 18 | 36 | 45 | 1.5 | 5.5 | 8.7 | 0.4 | 32.2 | −80 | 79 | Comp. Ex |
| | 900 | 18 | 36 | 45 | 1.6 | 5.6 | 10.4 | 0.1 | 34.0 | −80 | 100 | Ex. of invention |
| | 920 | 18 | 37 | 44 | 1.5 | 5.5 | 10.6 | 0.1 | 34.1 | −80 | 100 | Ex. of invention |
| | 940 | 17 | 36 | 46 | 1.6 | 5.7 | 10.7 | 0.1 | 33.4 | −80 | 100 | Ex. of invention |

The appearance of plating was evaluated based on the following criteria.

⊙: Plating deposited on 100% in terms of percentage area.

○: Plating deposited on not less than 90% in terms of percentage area.

Δ: Plating deposited on 60 to 90% in terms of percentage area.

X: Plating deposited on 30 to 60% in terms of percentage area.

XX: Plating deposited on not more than 30%.

In the evaluation of the adhesion of plating (powdering resistance), the plated sheen was bent at 180° C. for close overlapping, and an adhesive tape was adhered to the bent portion and then peeled off no measure the amount of peeled plating to evaluate the peeling of the galvanized coating. The evaluation was made based on the following five grades.

1: large peeling, 2: medium peeling, 3: small peeling, 4: very small peeling, and 5: no peeling.

The concentration of Fe in the plating was determined by X-ray diffractometry.

As is apparent from Table 4, the alloyed galvanized steel sheets of the present invention had good plating appearance and powdering resistance. Further, the concentration of Fe in the alloy layer corresponds to that of $\delta_1$ phase considered as a desired phase. In the present invention, the above properties are considered to be attained by reducing the amount of P and Si, which deteriorates plating adhesion and delays alloying reaction, and adding Mn or Cr. Further, it is apparent that, when Mn or Cr is added, the platability is not deteriorated even though P and Si are contained in a certain amount.

TABLE 4

| Sample No. | Appearance of plating | Powdering | Fe concentration, % | Remarks |
|---|---|---|---|---|
| 3-1 | ⊙ | 5 | 10.3 | Invention |
| 3-2 | ⊙ | 5 | 9.4 | Invention |
| 3-3 | Δ | 3 | 2.7 | Comparative steel |
| 3-4 | X | 2 | 3.8 | Comparative steel |
| 3-5 | XX | 2 | 2.6 | Comparative steel |
| 4-1 | ⊙ | 5 | 9.5 | Invention |
| 4-2 | ⊙ | 5 | 10.3 | Invention |
| 4-3 | XX | Impossible to measure | Impossible to measure | Comparative steel |
| 4-4 | Δ | 2 | 3.0 | Comparative steel |

of 5° C./sec and an average rate of cooling from 650° C. of 80° C./sec. Further, the annealed sheet was subjected to temper rolling with a reduction ratio of 0.5%, and a JIS No. 5 tensile specimen was extracted therefrom and subjected to a tensile test. The results of the tensile test are summarized in Table 6.

The BH value is the level of an increment of the stress when the tensile test is again effected after a 2% prestrained material is subjected to a heat treatment corresponding to painting baking at 170° C. for 20 min (that is, a value determined by subtracting 2% deformation stress from lower yield stress in the retensile test). The fabrication embrittlement transition temperature is a ductility-embrittlement transition temperature determined by punching a blank having a diameter of 50 mm from a temper-rolled steel sheet, molding a cup using a punch having a diameter of 33 mm and subjecting the cup to a drop weight test at various temperatures.

TABLE 5

| Sample No. | C | Si | Mn | P | S | Al | Cr | Ti | Nb | N | B | Remarks |
|---|---|---|---|---|---|---|---|---|---|---|---|---|
| 1-1 | 0.002 | 0.013 | 0.15 | 0.021 | 0.004 | 0.04 | — | 0.033 | — | 0.0013 | 0.0004 | Steel of invention |
| 1-2 | 0.003 | 0.007 | 0.63 | 0.007 | 0.005 | 0.04 | — | — | 0.025 | 0.0020 | — | Steel of invention |
| 1-3 | 0.004 | 0.011 | 0.81 | 0.010 | 0.006 | 0.03 | 0.4 | 0.010 | 0.012 | 0.0019 | 0.0005 | Steel of invention |
| 1-4 | 0.003 | 0.010 | 0.06 | 0.005 | 0.002 | 0.05 | — | — | — | 0.0015 | 0.0025 | Steel of invention |
| 1-5 | 0.003 | 0.012 | 0.09 | 0.008 | 0.003 | 0.040 | —* | —* | —* | 0.0019 | —* | Comparative steel |
| 2-1 | 0.002 | 0.015 | 1.15 | 0.025 | 0.006 | 0.03 | — | 0.021 | — | 0.0022 | 0.0010 | Steel of invention |
| 2-2 | 0.004 | 0.008 | 1.20 | 0.008 | 0.005 | 0.04 | 0.7 | — | 0.018 | 0.0015 | — | Steel of invention |
| 2-3 | 0.003 | 0.010 | 0.33 | 0.055 | 0.005 | 0.04 | — | 0.036 | 0.017 | 0.0024 | 0.0018 | Steel of invention |
| 2-4 | 0.003 | 0.015 | 0.15 | 0.050 | 0.005 | 0.04 | 1.5 | — | — | 0.0019 | — | Steel of invention |
| 3-1 | 0.002 | 0.011 | 1.40 | 0.065 | 0.006 | 0.03 | 1.0 | 0.021 | 0.011 | 0.0022 | 0.0002 | Steel of invention |
| 3-2 | 0.004 | 0.008 | 1.65 | 0.070 | 0.005 | 0.04 | — | — | 0.020 | 0.0015 | 0.0004 | Steel of invention |
| 3-3 | 0.004 | 0.022 | 0.40 | 0.080 | 0.008 | 0.04 | 0.8 | — | 0.008 | 0.0021 | 0.0006 | Steel of invention |
| 3-4 | 0.003 | 0.850* | 0.15 | 0.020 | 0.005 | 0.04 | 0.2 | 0.010 | 0.015 | 0.0022 | — | Comparative steel |
| 4-1 | 0.005 | 0.009 | 2.20 | 0.080 | 0.006 | 0.05 | — | 0.007 | 0.025 | 0.0014 | 0.0003 | Steel of invention |
| 4-2 | 0.003 | 0.012 | 1.75 | 0.075 | 0.008 | 0.04 | 1.6 | 0.020 | 0.019 | 0.0018 | — | Steel of invention |
| 4-3 | 0.008 | 0.930* | 0.41 | 0.060 | 0.007 | 0.05 | 0.1 | — | 0.015 | 0.0022 | 0.0023 | Comparative steel |
| 4-4 | 0.003 | 0.020 | 0.09 | 0.160* | 0.006 | 0.04 | — | 0.025 | — | 0.0016 | 0.0002 | Comparative steel |
| 5-1 | 0.003 | 0.015 | 1.85 | 0.110 | 0.005 | 0.03 | 1.0 | 0.026 | 0.014 | 0.0022 | 0.0008 | Steel of invention |
| 5-2 | 0.003 | 0.013 | 2.30 | 0.070 | 0.007 | 0.03 | 2.4 | 0.010 | 0.045 | 0.0019 | 0.0003 | Steel of invention |
| 5-3 | 0.004 | 0.310 | 0.70 | 0.160* | 0.009 | 0.04 | 1.0 | 0.025 | 0.006 | 0.0024 | 0.0003 | Comparative steel |

Note) Mark "*": outside the scope of the invention.

Example 4

Steels having compositions specified in Table 5 were prepared by a melt process and hot-rolled under conditions of a slab heating temperature of 1,180° C., a finishing temperature of 910° C. and a coiling temperature of 600° C. to form steel strips having a thickness of 4.0 min. After pickling, the steel strips were cold-rolled with a reduction ratio of 80% to form cold-rolled sheets having a thickness of 0.8 mm and then subjected to continuous annealing under conditions of a heating rate of 10° C./set, a soaking of 830° to 980° C. for 50 sec, an average rate of cooling to 650° C.

As is apparent from Table 6, the steels of the present invention have a higher BH property than the conventional steel sheets having a tensile strength on the same level as the steel sheets of the present invention, and additionally have a excellent non-aging properties at room temperature. This advantage is considered largely attributable to a better dislocation density of the steel sheet having a structure of low-temperature transformation products as compared with other steel sheets. Further, it is apparent that the steels of the present invention are excellent also in r value. Therefore, the steels of the present invention are suitable as a material for an outer or inner plate panel of automobiles, for example.

With respect to sample Nos. 1-1 to 1-4, in the examples of the present invention, the structure was brought to a of low-temperature transformation products by annealing in a γ single-phase region, whereas in the comparative examples, the annealing was effected in an α single-phase or (α+γ) two-phase region, so that a ferritic structure or a composite structure comprising ferrite and low temperature transformation products was formed.

Further, the annealed sheet was subjected to temper rolling with a reduction ratio of 0.5%, and a JIS No. 5 tensile specimen was extracted therefrom and subjected to a tensile test. The results of the tensile test are summarized in Table 7.

As is apparent from Table 7, when a structure of low-temperature transformation products is formed by annealing

TABLE 6

| Sample No. | YP, kgf/mm² | TS, kgf/mm² | El, % | r value | BH, kgf/mm² | YP-El, % | Brittle transition temp., °C. | Percentage volume of low temp. transformation product, % | Soaking temp., °C. | Remarks |
|---|---|---|---|---|---|---|---|---|---|---|
| 1-1 | 15 | 30 | 52 | 2.2 | 6.5 | 0.0 | −80 | 100 | 920 | Ex. of invention |
| | 14 | 29 | 53 | 2.4 | 1.2* | 0.3x* | −55 | 0* | 890* | Comp. Ex. |
| 1-2 | 13 | 30 | 53 | 2.4 | 6.8 | 0.0 | −80 | 100 | 900 | Ex. of invention |
| | 13 | 30 | 54 | 2.4 | 3.2* | 0.4x* | −65 | 54* | 890* | Comp. Ex. |
| 1-3 | 14 | 31 | 53 | 2.2 | 9.6 | 0.0 | −80 | 100 | 900 | Ex. of invention |
| | 13 | 30 | 54 | 2.1 | 4.5* | 0.5x* | −75 | 64* | 880* | Comp. Ex. |
| 1-4 | 16 | 30 | 50 | 1.8 | 8.5 | 0.0 | −80 | 100 | 930 | Ex. of invention |
| | 15 | 29 | 51 | 1.9 | 7.9 | 1.7x* | −80 | 0* | 890* | Comp. Ex. |
| 1-5 | 13 | 26 | 53 | 1.5 | 4.6* | 0.8x* | −50 | 100 | 920 | Comp. Ex. |
| 2-1 | 16 | 35 | 48 | 2.1 | 5.0 | 0.0 | −70 | 100 | 880 | Ex. of invention |
| | 15 | 35 | 49 | 2.2 | 2.3* | 0.5x* | −60 | 0* | 830* | Comp. Ex. |
| 2-2 | 17 | 35 | 46 | 2.4 | 8.8 | 0.0 | −75 | 100 | 870 | Ex. of invention |
| | 16 | 35 | 48 | 2.4 | 3.7* | 0.4x* | −55 | 16* | 850* | Comp. Ex. |
| 2-3 | 19 | 35 | 45 | 2.3 | 5.5 | 0.0 | −70 | 100 | 920 | Ex. of invention |
| | 18 | 35 | 45 | 2.4 | 2.2* | 0.2x* | −40 | 36* | 900* | Comp. Ex. |
| 2-4 | 21 | 36 | 44 | 1.7 | 6.1 | 0.0 | −70 | 100 | 880 | Ex. of invention |
| | 19 | 35 | 45 | 1.8 | 5.9 | 0.7x* | −65 | 3* | 863* | Comp. Ex. |
| 3-1 | 21 | 40 | 42 | 2.1 | 5.3 | 0.0 | −75 | 100 | 880 | Ex. of invention |
| | 19 | 40 | 42 | 2.2 | 1.5* | 0.3x* | −30 | 12* | 850* | Comp. Ex. |
| 3-2 | 24 | 40 | 41 | 1.8 | 10.5 | 0.1 | −75 | 100 | 885 | Ex. of invention |
| | 23 | 40 | 42 | 1.9 | 3.3* | 0.6x* | −60 | 13* | 840* | Comp. Ex. |
| 3-3 | 25 | 40 | 39 | 1.6 | 11.0 | 0.1 | −75 | 100 | 960 | Ex. of invention |
| | 23 | 40 | 40 | 1.7 | 5.3 | 1.1x* | −50 | 45* | 920* | Comp. Ex. |
| 3-4 | 29 | 40 | 32 | 1.2* | 7.2 | 0.7x* | −65 | 100 | 980 | Comp. Ex. |
| | 28 | 40 | 31 | 1.3* | 4.6 | 0.4x* | −55 | 38* | 960* | Comp. Ex. |
| 4-1 | 25 | 45 | 39 | 1.8 | 12.3 | 0.1 | −70 | 100 | 860 | Ex. of invention |
| | 24 | 45 | 40 | 1.8 | 8.6 | 0.4x* | −70 | 81 | 840* | Comp. Ex. |
| 4-2 | 26 | 44 | 37 | 1.7 | 6.4 | 0.0 | −76 | 100 | 840 | Ex. of invention |
| | 25 | 45 | 38 | 1.7 | 2.8 | 0.3x* | −45 | 70 | 830* | Comp. Ex. |
| 4-3 | 33 | 45 | 29 | 1.2* | 9.5 | 3.5x* | −50 | 100 | 980 | Comp. Ex. |
| | 31 | 45 | 30 | 1.2* | 8.7 | 2.1x* | −10 | 26 | 960* | Comp. Ex. |
| 4-4 | 35 | 45 | 30 | 1.2* | 5.5 | 0.2x* | −10 | 100 | 970 | Comp. Ex. |
| | 33 | 45 | 31 | 1.3* | 4.3* | 0.6x* | −10 | 66 | 950* | Comp.. Ex. |
| 5-1 | 28 | 51 | 36 | 1.7 | 7.6 | 0.0 | −70 | 100 | 860 | Ex. of invention |
| | 27 | 50 | 37 | 1.7 | 0.5* | 0.1 | −30 | 0* | 820* | Comp. Ex. |
| 5-2 | 27 | 50 | 37 | 2.0 | 4.6 | 0.0 | −65 | 100 | 840 | Ex. of invention |
| | 26 | 50 | 38 | 2.0 | 3.3* | 0.3x* | −40 | 68 | 820* | Comp. Ex. |
| 5-3 | 40 | 50 | 27 | 1.1* | 5.2 | 0.3x* | −20 | 100 | 980 | Comp. Ex. |
| | 39 | 50 | 27 | 1.2* | 4.7* | 0.4x* | −10 | 78 | 960* | Comp. Ex |

Note)
(1) Mark "x" in the column of YP-El: YP-El after artificial aging treatment at 100° C. for 1 hr.
(2) Mark "*": outside the scope of the invention

Example 5

The influence of soaking temperature in continuous annealing was studied using steel No. 3-2 specified in Table 5. Conditions for hot rolling and cold rolling were the same as those of Example 1. Thereafter, the cold-rolled steel sheet was subjected to continuous annealing as follows. It was heated at a rate of 10° C./sec, held at a temperature in the range of from 840° to 930° C. for 50 sec, cooled at an average rate of 60° C./sec.

in a γ single-phase region according to the present invention, an excellent quality can be stably provided even though the soaking temperature is changed. On the other hand, when annealing was effected in an (α+γ) two-phase region, a slight change in soaking temperature gave rise to a wide variation in BH property. Further, the YP-El after artificial aging exceeded 0.2%, and the non-aging property could not be ensured.

TABLE 7

| Sample No. | Soaking temp. | YP, kgf/mm² | TS, kgf/mm² | El, % | r value | BH, kgf/mm² | YP-El, % | Brittle transi-temp., °C. | Percentage volume of low temp. transformation product, % | Remarks |
|---|---|---|---|---|---|---|---|---|---|---|
| 3-2 | 840 | 23 | 41 | 42 | 1.9 | 3.1 | 0.3* | −60 | 13 | Comp. Ex. |
| | 860 | 22 | 40 | 43 | 1.8 | 4.8 | 1.2* | −70 | 42 | Comp. Ex. |
| | 870 | 23 | 42 | 41 | 1.7 | 7.4 | 0.7* | −70 | 77 | Comp. Ex. |
| | 890 | 24 | 40 | 41 | 1.9 | 10.7 | 0.0 | −75 | 100 | Ex. of invention |
| | 910 | 24 | 41 | 40 | 1.8 | 11.2 | 0.1 | −70 | 100 | Ex. of invention |
| | 930 | 23 | 40 | 42 | 1.8 | 11.5 | 0.1 | −75 | 100 | Ex. of invention |

Note) Mark "*": outside the scope of the invention

Example 6

Sample Nos. 3-1 to 3-4 and 4-1 to 4-4 specified in Table 5 were hot-rolled under conditions of a slab heating temperature of 1220° C., a finishing temperature of 900° C. and a coiling temperature of 500° C. to form steel sheets having a thickness of 3.8 mm. After pickling, the steel sheets were cold-rolled to form cold-rolled sheets having a thickness of 0.75 mm, heated at a heating rate of 15° C./sec to a maximum heating temperature in the range of from 840° to 980° C., cooled at a rate of about 70° C./sec, subjected to conventional hot-dip galvanizing at 460° C. (Al concentration of bath: 0.11%), further heated at 520° C. for 20 sec to effect alloying and then cooled to room temperature at about 20° C./sec. The resultant alloyed galvanized steel sheets were subjected to measurement of appearance of plating, powdering resistance and concentration of Fe in plating. The results are summarized in Table 8.

TABLE 8

| Sample No. | Appearance of plating | Powdering | Fe concentration, % | Percentage volume of low temp. transformation product, % | Remarks |
|---|---|---|---|---|---|
| 3-1 | ◎ | 5 | 10.3 | 100 | Ex. of invention |
| 3-2 | ◎ | 5 | 10.1 | 100 | Ex. of invention |
| 3-3 | ○ | 4 | 9.4 | 100 | Ex. of invention |
| 3-4 | XX* | Impossible to measure* | Impossible to measure* | 100 | Comp. Ex. |
| 4-1 | ◎ | 5 | 10.5 | 100 | Ex. of invention |
| 4-2 | ◎ | 5 | 9.8 | 100 | Ex. of invention |
| 4-3 | XX* | Impossible to measure* | Impossible to measure* | 100 | Comp. Ex. |
| 4-4 | Δ* | 2* | 2.1* | 100 | Comp. Ex. |

Note) Mark "*": outside the scope of the invention.

In the table, the evaluation of the appearance of plating and powdering resistance and the measurement of the concentration of Fe in plating were effected in the same manner as that of Example 3.

As is apparent from Table 4, the alloyed galvanized steel sheets of the present invention had good plating appearance and powdering resistance. Further, the concentration of Fe in the alloy layer corresponds to that of $\delta_1$ phase considered as a desired phase.

INDUSTRIAL APPLICABILITY

As is apparent from the foregoing description, according to the present invention, it is possible to provide a cold-rolled steel sheet having a combination of BH property with non-aging properties at room temperature unattainable by the prior art techniques. Further, the steel of the present invention has an excellent press moldability and is excellent also in platability in hot-dip galvanizing, so that it can exhibit also a rust preventive property. Therefore, use of the steel of the present invention in bodies or frames of automobiles enables the thickness of the sheet, that is, the weight of the automobile bodies, to be reduced, which can greatly contribute to environmental protection which has attracted attention in recent years. Thus, the present invention is very valuable from the viewpoint of industry.

We claim:

1. A cold-rolled steel sheet having excellent bake hardenability and non-aging properties at room temperature, consisting essentially of, in terms of % by weight, 0.0005 to 0.0070% of C, 0.001 to 0.8% of Si, 0.3 to 4.0% of Mn, 0.002 to 0.15% of P, 0.0005 to 0.015% of S, 0.005 to 0.1% of Al and 0.0003 to 0.0060% of N with the balance consisting of Fe and unavoidable impurities and composed of a structure of only low-temperature transformation products consisting of at least one member selected from the group consisting of massive ferrite, bainite, Widmanstatten ferrite, martensite, and acicular ferrite, said cold-rolled steel sheet having a bake hardenability property, BH, of not less than 5 kgf/mm².

2. The cold-rolled steel sheet according to claim 1, which further consists essentially of at least one element selected from the group consisting of B in an amount satisfying a requirement of less than 0.0030% by weight with $B/N \leqq 1.5$ and 0.01 to 3.0% by weight of Cr.

3. A cold-rolled steel sheet having excellent bake hardenability and moldability, consisting essentially of, in terms of % by weight, 0.0005 to 0.0070% of C, 0.001 to 0.8% of Si, 0.01 to 4.0% of Mn, 0.002 to 0.15% of P, 0.0005 to 0.015% of S, 0.005 to 0.1% of Al and 0.0003 to 0.0060% of N and further consisting essentially of at least one additional element selected from the group consisting of 0.003 to 0.1% to Ti and 0.003 to 0.1% of Nb with the balance consisting of Fe and unavoidable impurities and composed of a structure of only low-temperature transformation products, said cold-rolled steel sheet having a bake hardenability property, BH, of not less than 5 kgf/mm².

4. The cold-rolled steel sheet according to claim 3, which further consists essentially of at least one element selected from the group consisting of less than 0.0030% by weight of B and 0.01 to 3.0% by weight of Cr.

5. The cold-rolled steel sheet according to claim 3, wherein the structure of only low-temperature transformation products consists of at least one member selected from the group consisting of massive ferrite, bainite, Widmanstatten ferrite, martensite and acicular ferrite.

6. A hot-dip galvanized cold-rolled steel sheet having excellent bake hardenability and non-aging properties at room temperature, consisting essentially of, in terms of % by weight, 0.0005 to 0.0070% C, 0.001 to 0.8% of Si, 0.3 to 4.0% of Mn, 0.002 to 0.15% of P, 0.0005 to 0.015% of S, 0.005 to 0.1% of Al and 0.0003 to 0.0060% of N with the balance consisting of Fe and unavoidable impurities and composed of a structure of only low-temperature transformation products, said hot-dip galvanized cold-rolled steel sheet having a bake hardenability property, BH, of not less than 5 $kgf/mm^2$.

7. The hot-dip galvanized cold-rolled steel sheet according to claim 6, which further consists essentially of at least one element selected from the group consisting of B in an amount satisfying a requirement of less than 0.0030% by weight with $B/N \leqq 1.5$ and 0.01 to 3.0% by weight of Cr.

8. The hot-dip galvanized cold-rolled steel sheet according to claim 6, wherein the structure of only low-temperature transformation products consists of at least one member selected from the group consisting of massive ferrite, bainite, Widmanstatten ferrite, martensite and acicular ferrite.

9. A hot-dip galvanized cold-rolled steel sheet having excellent bake hardenability and moldability, consisting essentially of, in terms of % by weight, 0.0005 to 0.0070% of C, 0.001 to 0.8% of Si, 0.01 to 4.0% of Mn, 0.002 to 0.15% of P, 0.0005 to 0.015% of S, 0.005 to 0.1% of Al and 0.0003 to 0.0060% of N and further consisting essentially of at least one additional element selected from the group consisting of 0.003 to 0.1% of Ti and 0.003 to 0.1% of Nb with the balance consisting of Fe and unavoidable impurities and composed of a structure of only low-temperature transformation products, said hot-dip galvanized cold-railed steel sheet having a bake hardenability property, BH, of not less than 5 $kgf/mm^2$.

10. The hot-dip galvanized cold-rolled steel sheet according to claim 9, which further consists essentially of at least one element selected from the group consisting of less than 0.0030% by weight of B and 0.01 to 3.0% by weight of Cr.

11. The hot-dip galvanized cold-rolled steel sheet according to claim 9, wherein the structure of only low-temperature transformation products consists of at least one member selected from the group consisting of massive ferrite, bainite, Widmanstatten ferrite, martensite and acicular ferrite.

12. A process for producing a cold-rolled steel sheet having excellent bake hardenability and non-aging properties at room temperature, comprising the steps of: heating a slab consisting essentially of, in terms of % by weight, 0.0005 to 0.0070% of C, 0.001 to 0.8% of Si, 0.3 to 4.0% of Mn, 0.002 to 0.15% of P, 0.0005 to 0.015% of S, 0.005 to 0.1% of Al and 0.0003 to 0.0060% of N with the balance consisting of Fe and unavoidable impurities to provide a heated slab; hot-rolling the heated slab at a finish hot rolling temperature of not lower than $(Ar_3-100)$°C. to provide a hot-rolled steel strip; coiling the hot-rolled steel strip at a temperature of not higher than 750° C. to provide a coil of hot-rolled steel strip; cold-rolling the hot-rolled steel strip uncoiled from the coil of hot-rolled steel strip with a reduction ratio of not less than 60% to provide a cold-rolled steel strip; subjecting the cold-rolled steel strip to continuous annealing at an annealing temperature of not lower than the $Ac_3$ transformation point and in a $\gamma$ single-phase region, thereby providing a cold-rolled steel sheet having a structure of only low temperature transformation products.

13. A process for producing a cold-rolled steel sheet according to claim 12, wherein the slab further consists essentially of at least one element selected from the group consisting of B in an amount satisfying a requirement of less than 0.0030% by weight with $B/N \leqq 1.5$ and 0.01 to 3.0% by weight of Cr.

14. A process for producing a cold-rolled steel sheet having excellent bake hardenability and non-aging properties at room temperature, comprising the steps of: heating a slab consisting essentially of, in terms of % by weight, 0.0005 to 0.0070% of C, 0.001 to 0.8% of Si, 0.01 to 4.0% of Mn, 0.002 to 0.15% of P, 0.0005 to 0.015% of S, 0.005 to 0.1% of Al and 0.0003 to 0.0060% of N and at least one element selected from the group consisting of 0.003 to 0.1% of Ti and 0.003 to 0.1% of Nb with the balance consisting of Fe and unavoidable impurities to provide a heated slab; hot-rolling the heated slab at a finish hot rolling temperature of not lower than $(Ar_3-100)$°C. to provide a hot-rolled steel strip; coiling the hot-rolled steel strip at a temperature of not higher than 750° C. to provide a coil of hot-rolled steel strip; cold-rolling the hot-rolled steel strip uncoiled from the coil of hot-rolled steel strip with a reduction ratio of not less than 60% to provide a cold-rolled steel strip; subjecting the cold-rolled steel strip to continuous annealing at an annealing temperature of not lower than the $Ac_3$ transformation point and in a $\gamma$ single-phase region, thereby providing a cold-rolled steel sheet having a structure of only low temperature transformation products.

15. A process for producing a cold-rolled steel sheet according to claim 14, wherein the slab further consists essentially of at least one element selected from the group consisting of B in an amount satisfying a requirement of less than 0.0030% by weight with $B/N \leqq 1.5$ and 0.01 to 3.0% by weight of Cr.

16. A process for producing a hot-dip galvanized cold-rolled steel sheet having excellent bake hardenability and non-aging properties at room temperature, comprising the steps of: heating a slab consisting essentially of, in terms of % by weight, 0.0005 to 0.0070% of C, 0.001 to 0.8% of Si, 0.3 to 4.0% of Mn, 0.002 to 0.15% of P, 0.0005 to 0.015% of S, 0.005 to 0.1% of Al and 0.0003 to 0.0060% of N with the balance consisting of Fe and unavoidable impurities to provide a heated slab; hot-rolling the heated slab at a finish hot rolling temperature of not lower than $(Ar_3-100)$°C. to provide a hot-rolled steel strip; coiling the hot-rolled steel strip at a temperature of not higher than 750° C. to provide a coil of hot-rolled steel strip; cold-rolling the hot-rolled steel strip uncoiled from the coil of hot-rolled steel strip with a reduction ratio of not less than 60% to provide a cold-rolled steel strip; subjecting the cold-rolled steel strip to in-line annealing hot-dip galvanizing at an annealing temperature of not lower than the $Ac_3$ transformation point and in a $\gamma$ single-phase region, thereby providing a hot-dip galvanized cold-rolled steel sheet having a structure of only low temperature transformation produces.

17. The process for producing a hot-dip galvanized cold-rolled steel sheet according to claim 16, wherein the slab further consists essentially of at least one element selected from the group consisting of B in an amount satisfying a requirement of less than 0.0030% by weight with $B/N \leqq 1.5$ and 0.01 to 3.0% by weight of Cr.

18. A process for producing a hot-dip galvanized cold-rolled steel sheet having excellent bake hardenability and non-aging properties at room temperature, comprising the steps of: heating a slab consisting essentially of, in terms of % by weight, 0.0005 to 0.0070% of C, 0.001 to 0.8% of Si, 0.01 to 4.0% of Mn, 0.002 to 0.15% of P, 0.0005 to 0.015% of S, 0.005 to 0.1% of Al and 0.0003 to 0.0060% of N and at lease one element selected from the group consisting of 0.003 to 0.1% of Ti and 0.003 to 0.1% of Nb with the balance consisting of Fe and unavoidable impurities to provide a heated slab; hot-rolling the heated slab at a finish hot rolling temperature of not lower than ($Ar_3$—100)°C. to provide a hot-rolled steel strip; coiling the hot-rolled steel strip at a temperature of not higher than 750° C. to provide a coil of hot-rolled steel strip; cold-rolling the hot-rolled steel strip uncoiled from the coil of hot-rolled steel strip with a reduction ratio of not less than 60% to provide a cold-rolled steel strip; subjecting the cold-rolled steel strip to in-line annealing hot-dip galvanizing at an annealing temperature of not lower than the $Ac_3$ transformation point and in a $\gamma$ single-phase region, thereby providing a hot-dip galvanized cold-rolled steel sheet having a structure of only low-temperature transformation products.

19. The process for producing a cold-rolled steel sheet according to claim 18, wherein the slab further consists essentially of at least one element selected from the group consisting of B in an amount satisfying a requirement of less than 0.0030% by weight with $B/N \leqq 1.5$ and 0.01 to 3.0% by weight of Cr.

* * * * *

UNITED STATES PATENT AND TRADEMARK OFFICE

CERTIFICATE OF CORRECTION

PATENT NO. : 5,690,755

DATED : November 25, 1997

INVENTOR(S) : Naoki YOSHINAGA, et al.

It is certified that error appears in the above-indentified patent and that said Letters Patent is hereby corrected as shown below:

Column 1, line 14, change "sheen" to --sheet--.

Column 1, line 19, change "no" to --to--.

Column 1, line 32, change "no" to --to--.

Column 1, line 50, delete "that".

Column 3, line 7, delete "have".

Column 3, line 15, insert --and-- between "Mn," and "Cr,".

Column 3, line 40, after "level," insert --and--.

Column 3, line 47, change "problems;" to --problems:--.

Column 4, line 2, delete "a" before "non-aging".

Column 4, line 15, change "a" to --an--.

Column 4, line 51, after "non-aging" insert --properties--.

Column 4, line 59, delete "a".

Column 5, line 33, after "annealing" insert --in--.

UNITED STATES PATENT AND TRADEMARK OFFICE

CERTIFICATE OF CORRECTION

PATENT NO. : 5,690,755

DATED : November 25, 1997

INVENTOR(S) : Naoki YOSHINAGA, et al.

It is certified that error appears in the above-indentified patent and that said Letters Patent is hereby corrected as shown below:

Column 5, line 41, change "even" to --Even--.

Column 5, line 61, change "Nb;" to --Nb,--.

Column 6, line 26, change "mount" to --amount--.

Column 6, line 45, change "p" to --P--.

Column 7, line 53, change "$AC_3$" to --$Ac_3$--.

Column 7, line 63, change "Mu" to --Mn--.

Column 8, line 3, delete "a".

Column 9, line 23, change "with" to --With--.

Column 10, line 37, change "m" to --mm--.

Column 11, line 41, delete "a".

Column 14, line 59, change "sheen" to --sheet--.

Column 14, line 61, change "no" to --to--.

Column 15, line 61, change "min." to --mm-.

Column 15, line 66, change "C/set." to --C/sec.--.

UNITED STATES PATENT AND TRADEMARK OFFICE

CERTIFICATE OF CORRECTION

PATENT NO. : 5,690,755

DATED : November 25, 1997

INVENTOR(S) : Naoki YOSHINAGA, et al.

It is certified that error appears in the above-indentified patent and that said Letters Patent is hereby corrected as shown below:

Column 16, lines 7-10, delete space between paragraphs.

Column 16, line 60, change "a" to --an--.

Column 17, line 2, after "a" insert --structure--.

Column 20, line 59, change "to Ti" to --of Ti--.

Column 21, line 9, after "0.0070%" insert --of--.

Column 21, line 38, change "cold-railed" to --cold-rolled--.

Column 22, line 58, change "produces." to --products.--.

Signed and Sealed this

Fourteenth Day of July, 1998

Bruce Lehman

*Attest:*

BRUCE LEHMAN

*Attesting Officer*

*Commissioner of Patents and Trademarks*